US007651075B2

(12) United States Patent
Rho et al.

(10) Patent No.: US 7,651,075 B2
(45) Date of Patent: Jan. 26, 2010

(54) BUBBLE GENERATOR

(75) Inventors: Samuel S. Rho, Hasienda Heights, CA (US); Jae-Hak Eom, Masan (KR)

(73) Assignee: Rhos Enterprise, Inc, Hacienda Heights, CA (US)

( * ) Notice: Subject to any disclaimer, the term of this patent is extended or adjusted under 35 U.S.C. 154(b) by 461 days.

(21) Appl. No.: 11/757,115

(22) Filed: Jun. 1, 2007

(65) Prior Publication Data

US 2008/0296788 A1 Dec. 4, 2008

(51) Int. Cl.
*B01F 3/04* (2006.01)

(52) U.S. Cl. ..... 261/91; 261/93

(58) Field of Classification Search ..... 261/84, 261/91, 93

See application file for complete search history.

(56) References Cited

U.S. PATENT DOCUMENTS

| | | | | | |
|---|---|---|---|---|---|
| 2,085,947 | A * | 7/1937 | Booth | ..... | 261/93 |
| 2,182,442 | A * | 12/1939 | Booth | ..... | 209/168 |
| 2,928,665 | A * | 3/1960 | Epprecht | ..... | 261/87 |
| 3,814,396 | A * | 6/1974 | Di Gregorio et al. | ..... | 261/93 |
| 5,194,144 | A | 3/1993 | Blough | | |
| 5,951,867 | A | 9/1999 | Blough | | |
| 6,245,237 | B1 | 6/2001 | Blough | | |
| 6,461,500 | B1 | 10/2002 | Hoage | | |
| 6,884,353 | B2 | 4/2005 | Hoage | | |
| 7,264,232 | B2 * | 9/2007 | Rohde | ..... | 261/91 |
| 2001/0013666 | A1 * | 8/2001 | Nomura et al. | ..... | 261/93 |

* cited by examiner

*Primary Examiner*—Scott Bushey
(74) *Attorney, Agent, or Firm*—John K. Park; Park Law Firm

(57) ABSTRACT

A bubble generator includes an air intake device, an air guide device, an aeration disc and a rotating device. The air guide device is partially immersed in liquid and guides air flowed into the air guide device through the air intake device toward the liquid. The aeration disc produces negative pressure by being rotated in the liquid and moving the liquid whereby air guided by the air guide device produces air bubbles in the liquid. The aeration disc comprises one or more blades that spin to create a vacuum of air moving downward through the air intake device and air guide device and into the liquid, and an arcuate wall that comprises one or more slots.

11 Claims, 9 Drawing Sheets

BUBBLE GENERATOR

BACKGROUND OF THE INVENTION

The present invention relates to a bubble generator or aeration apparatus. More particularly, this invention relates to a bubble generator for aerating septic tank waste water that can produce substantial amount of micro scale air bubbles with a simple rotating mechanism that consumes minimal energy.

An aeration apparatus is used to produce gas bubbles in liquid. In a septic tank, an aeration apparatus is to supply oxygen in the waster water in the tank to promote decomposition of organic sludge by aerobic bacteria.

U.S. Pat. Nos. 5,194,144, 5,951,867 and 6,245,237 disclose an aeration apparatus for septic tanks. Air enters the upper end of a shaft and exits adjacent a propeller. The propeller rotates in the waste water. With high speed rotation of the propeller, air is moved from the atmosphere along the shaft and injected into the water as tiny air bubbles. The aeration apparatus agitates water with the propeller to produce air bubbles and move the produced air bubbles. Large energy was needed to rotate the propeller and the rotation of the propeller to agitate the water caused vibration of the parts rotating the propeller and interference of objects with the propeller and the driving parts.

U.S. Pat. Nos. 6,461,500 and 6,884,353, which are incorporated by reference in this application, disclose an aeration apparatus for septic tanks, which includes an impeller driven by a motor, and an air plate positioned between the impeller and the motor and having a series of concentrically positioned apertures. Air is injected into the waste water through the apertures of the air plate as the impeller is rotated by the motor. Air bubbles have smaller size, and the movement of water induced by the rotation of the impeller is much smaller compared to the apparatus of U.S. Pat. No. 6,245,237, so that the sludge in the tank is not agitated. The aeration apparatus of U.S. Pat. Nos. 6,461,500 and 6,884,353 has disadvantages that the apertures of the air plate are plugged easily; it is hard to balance the impeller and resulting vibration ruins the motor; and there is limit on pitch of the impeller for greater negative pressure.

The efficiency of aeration apparatus is closely related to the number and size of air bubbles that the apparatus produces. The smaller the size of bubbles is, the more efficient the aeration apparatus is. Smaller bubbles stay longer in the water, are easier to be dispersed by Brownian movement, and more efficient in transfer of oxygen since they have greater surface are for the same amount of air made into bubbles. There has long been a need to a bubble generator that can produce air bubbles having smaller size.

SUMMARY OF THE INVENTION

The present invention contrives to solve the disadvantages of the prior art and to satisfy the need that was not addressed by the prior art.

An objective of the invention is to provide a bubble generator that can provide micro size air bubbles that is far smaller than prior art.

Another objective of the invention is to provide a bubble generator that consumes minimal energy.

To achieve the above objectives, the present invention provides a bubble generator that includes an air intake device, an air guide device, an aeration disc and a rotating device that rotates the aeration disc.

The air guide device is adapted to be at least partially immersed in liquid. The air guide device guides air flowed into the air guide device through the air intake device toward the liquid.

The aeration disc is attached to the air guide device and produces negative pressure by being rotated in the liquid and moving the liquid whereby air guided by the air guide device produces air bubbles in the liquid.

The air intake device provides ambient air into an air guide device. The aeration disc comprises one or more blades that spin to create a vacuum of air moving downward through the air intake device and air guide device and into the liquid, and an arcuate wall that comprises one or more slots.

The blades extend radially from the center of the aeration disc. The arcuate wall is connected with the blades. The arcuate wall forms a circumferential wall. Each of the slots of the arcuate wall comprises an open end, and the open end is directed toward the liquid.

The circumferential wall comprises an annular ring that has a constant width and positioned cylindrical with respect to the rotation axis of the aeration disc.

The air guide device comprises a hollow cylinder having an upper open end and a lower open end. The aeration disc is installed at the lower open end.

The air guide device further comprises a shaft guide which is installed inside the hollow cylinder and above and near to the aeration disc. The shaft guide comprises an outer annular ring and a central air guide opening, wherein the outer annular ring comprises an outer peripheral wall that is fitted inside the hollow cylinder and an inner peripheral wall that defines the central air guide opening.

The shaft guide further comprises an inner annular ring. The rotating device comprises a motor and a shaft that connects the motor and the aeration disc. The shaft is rotationally held by the inner annular ring.

The shaft guide further comprises a bearing that is received in the inner annular ring and supports the shaft.

The bubble generator further comprises a motor mounting, on which the rotating device is mounted, and a motor cover, which encloses the rotating device. The motor mounting is installed on the upper open end of the hollow cylinder. The motor cover comprises a chimney fitting.

The air intake device comprises one or more air intake control valves that adjust the amount of air flowing into the air guide device. The air intake control valves are installed on the motor mounting.

The advantages of the present invention are: (1) the bubble generator uses a single rotating disc without the need of a separate air plate, thereby removing a barrier to air flow; (2) the air moves much more easily into water; (3) the size of air bubbles is very small and stays very long in water; (4) the number of air bubbles created is very large; and (5) the bubble generator uses less power and less noisy compared to prior art machines.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
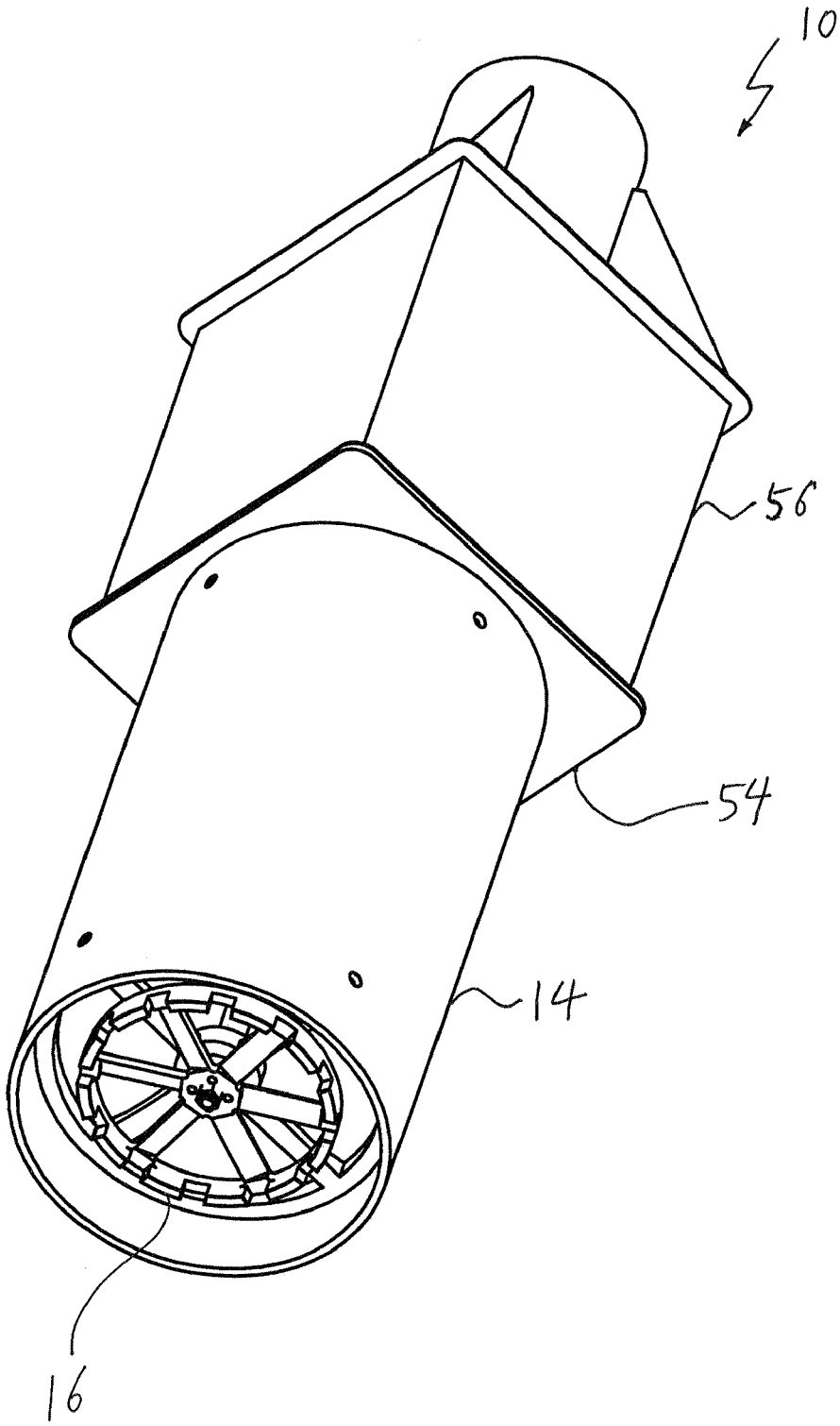
FIG. 1 is a perspective view of a bubble generator according to the present invention.
Figure 2:
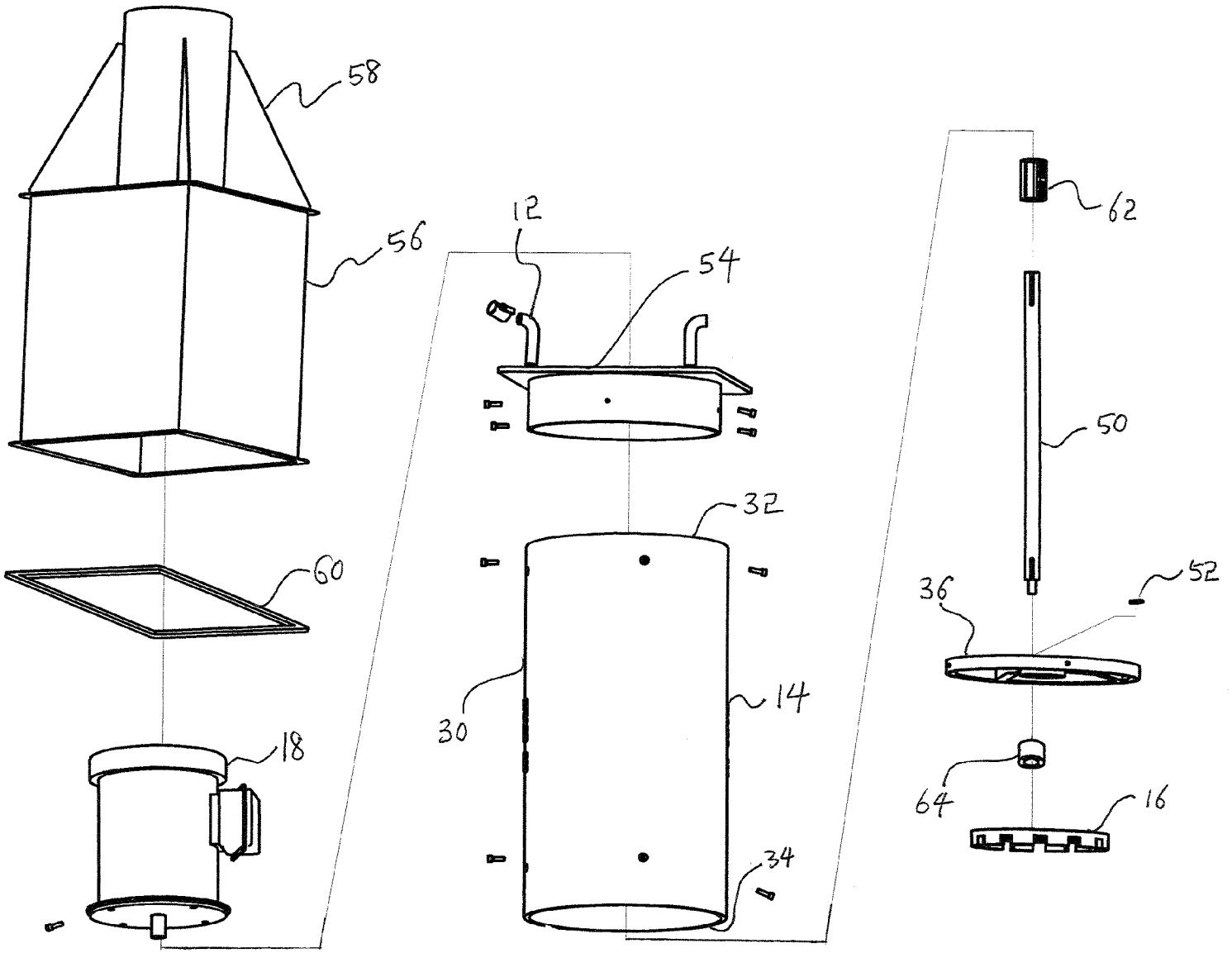
FIG. 2 is an exploded perspective view of the bubble generator.

FIGS. 1 and 2 show a bubble generator 10 of the present invention. The bubble generator 10 includes an air intake device 12, an air guide device 14, an aeration disc 16 and a rotating device 18 that rotates the aeration disc 16.

The air guide device 14 is adapted to be at least partially immersed in liquid in which bubbles generated by the bubble generator 10 are to be dispersed. The air guide device 14 guides air flowed into the air guide device 14 through the air intake device 12 toward the liquid.

The aeration disc 16 is attached to the air guide device 14 and produces negative pressure by being rotated in the liquid and moving the liquid whereby air guided by the air guide device 14 produces air bubbles in the liquid.

Figure 3:
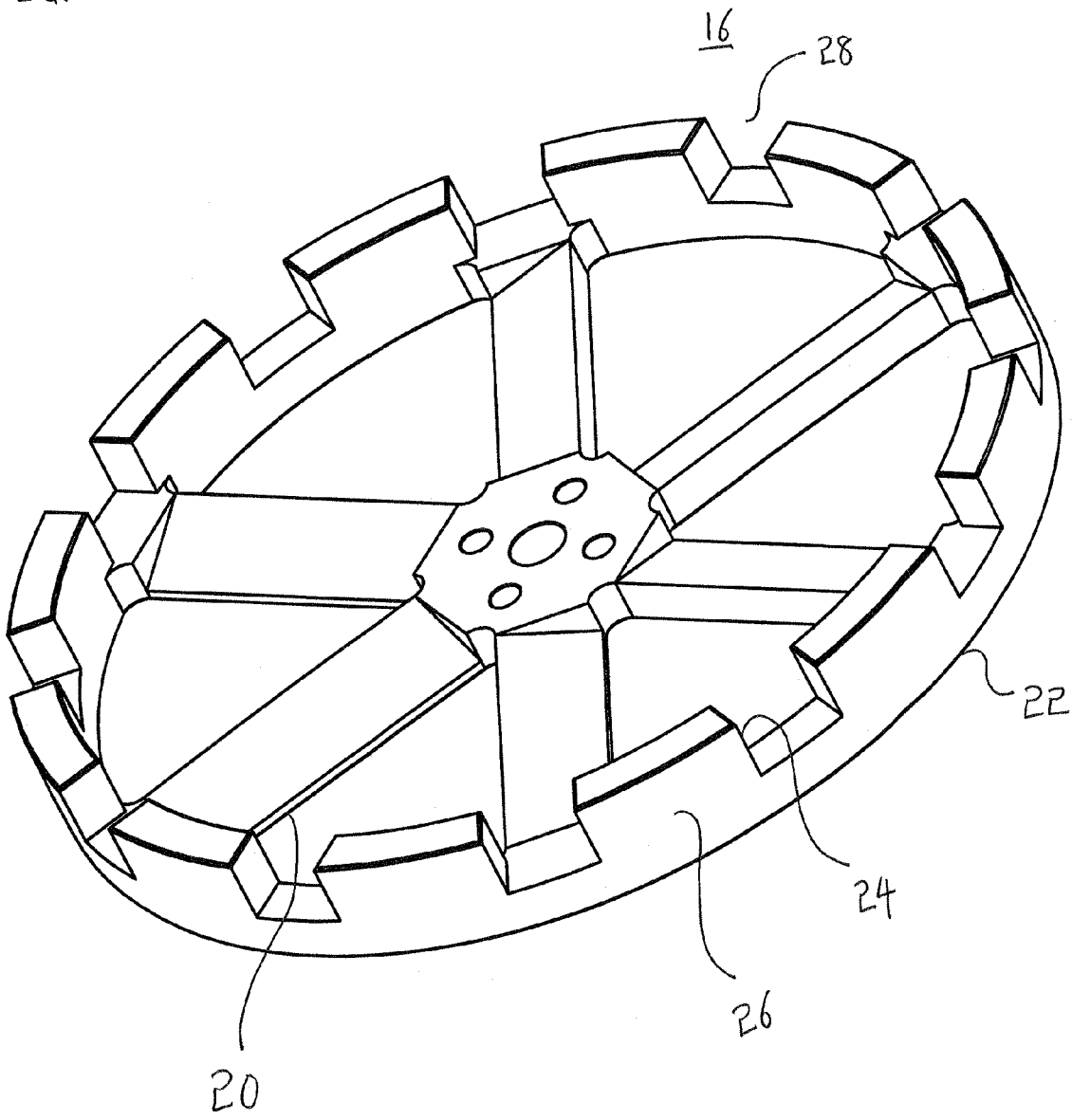
FIG. 3 is a perspective view of an aeration disc.
Figure 4:
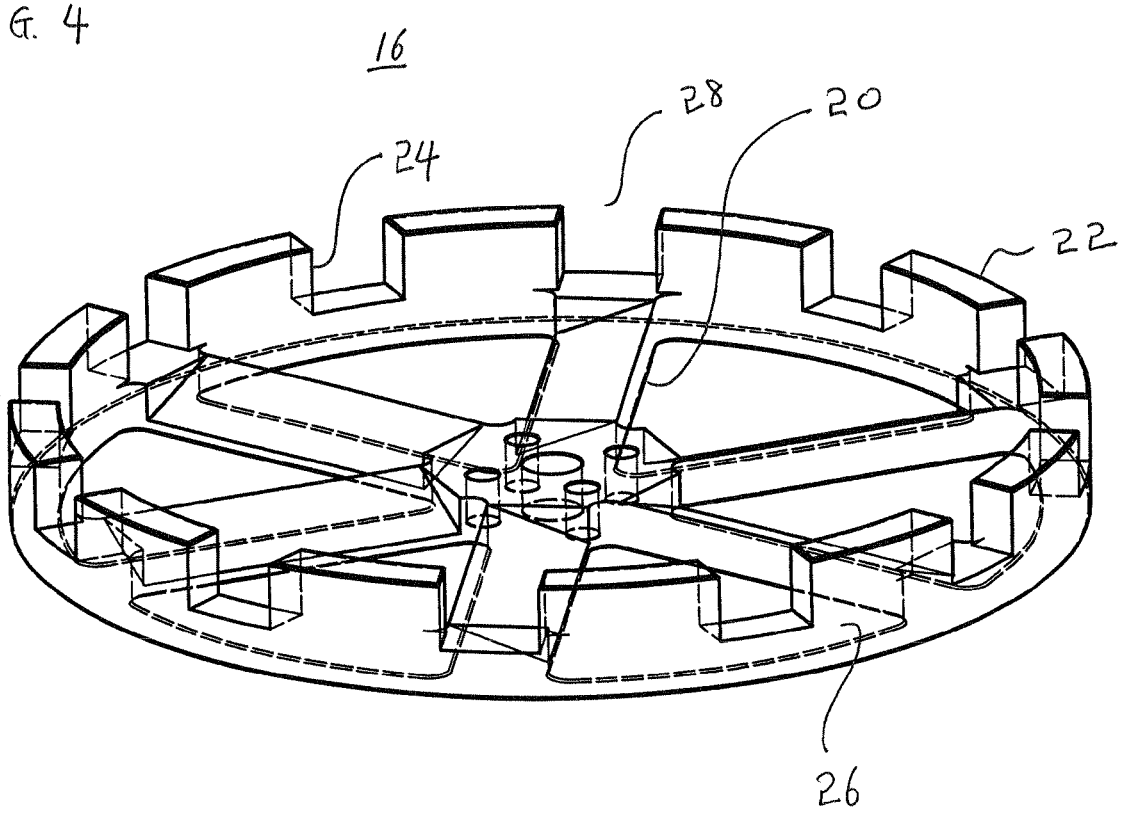
FIG. 4 is another perspective view of the aeration disc.
Figure 5:
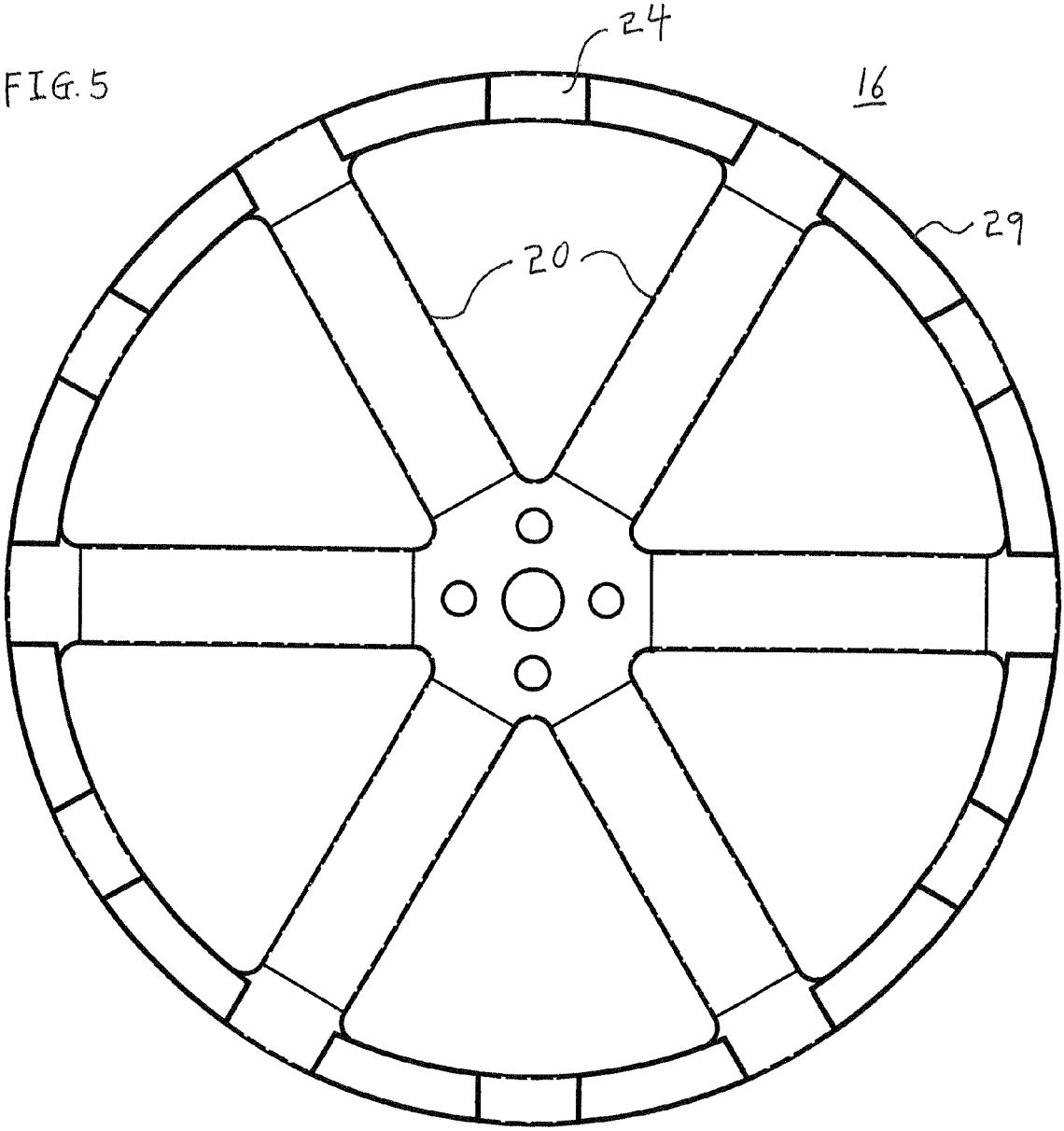
FIG. 5 is a plan view of the aeration disc.

The air intake device 12 provides ambient air into an air guide device 14. FIGS. 3-5 shows that the aeration disc 16 comprises one or more blades 20 that spin to create a vacuum of air moving downward through the air intake device 12 and air guide device 14 and into the liquid, and an arcuate wall 22 that comprises one or more slots 24.

The blades 20 extend radially from the center of the aeration disc 16. The arcuate wall 22 is connected with the blades 20. In the embodiment shown, the arcuate wall 22 forms a circumferential wall 26. Each of the slots 24 of the arcuate wall 22 comprises an open slot end 28, and the aeration disc 16 is assembled so that the open slot end 28 is directed toward the liquid (Refer to FIG. 1).

The circumferential wall 26 comprises an annular ring 29 that has a constant width and positioned cylindrical with respect to the rotation axis of the aeration disc 16.

The blades 20 and the slots 24 are symmetrically and/or concentrically positioned on the aeration disc 16. The symmetry and dimensional precision of the blades and the arcuate wall 22 is very important for balancing of the aeration disc 16 rotating at high speed.

Referring back to FIG. 2, the air guide device 14 comprises a hollow cylinder 30 having an upper open end 32 and a lower open end 34. The aeration disc 16 is installed at the lower open end 34.

Figure 6:
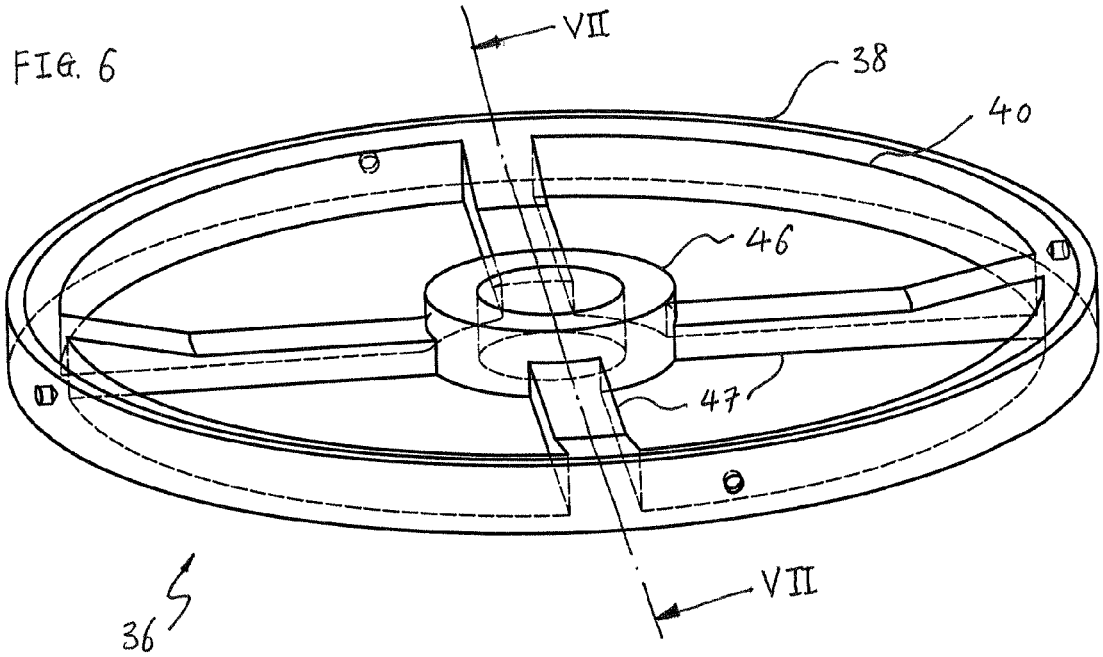
FIG. 6 is a perspective view of a shaft guide.
Figure 7:
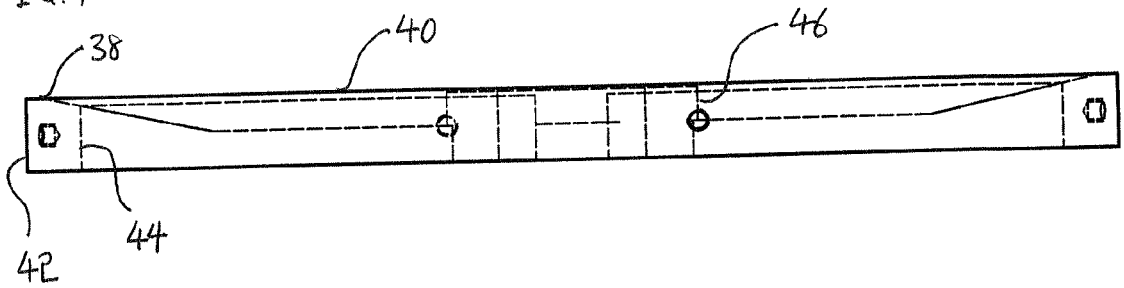
FIG. 7 is a cross-sectional view taken along line VII-VII in FIG. 6.

The air guide device 14 further comprises a shaft guide 36 which is installed inside the hollow cylinder 30 and above and near to the aeration disc 16. FIGS. 6 and 7 show that the shaft guide 36 comprises an outer annular ring 38 and a central air guide opening 40. The outer annular ring 38 comprises an outer peripheral wall 42 that is fitted inside the hollow cylinder 30 and an inner peripheral wall 44 that defines the central air guide opening 40.

The shaft guide 36 further comprises an inner annular ring 46. The rotating device 18 comprises a motor 48 (refer to FIG. 8) and a shaft 50 that connects the motor 48 and the aeration disc 16. The shaft 50 is rotationally held by the inner annular ring 46.

The shaft guide 36 further comprises a bearing 52 that is received in the inner annular ring 46 and supports the shaft 50.

Figure 8:
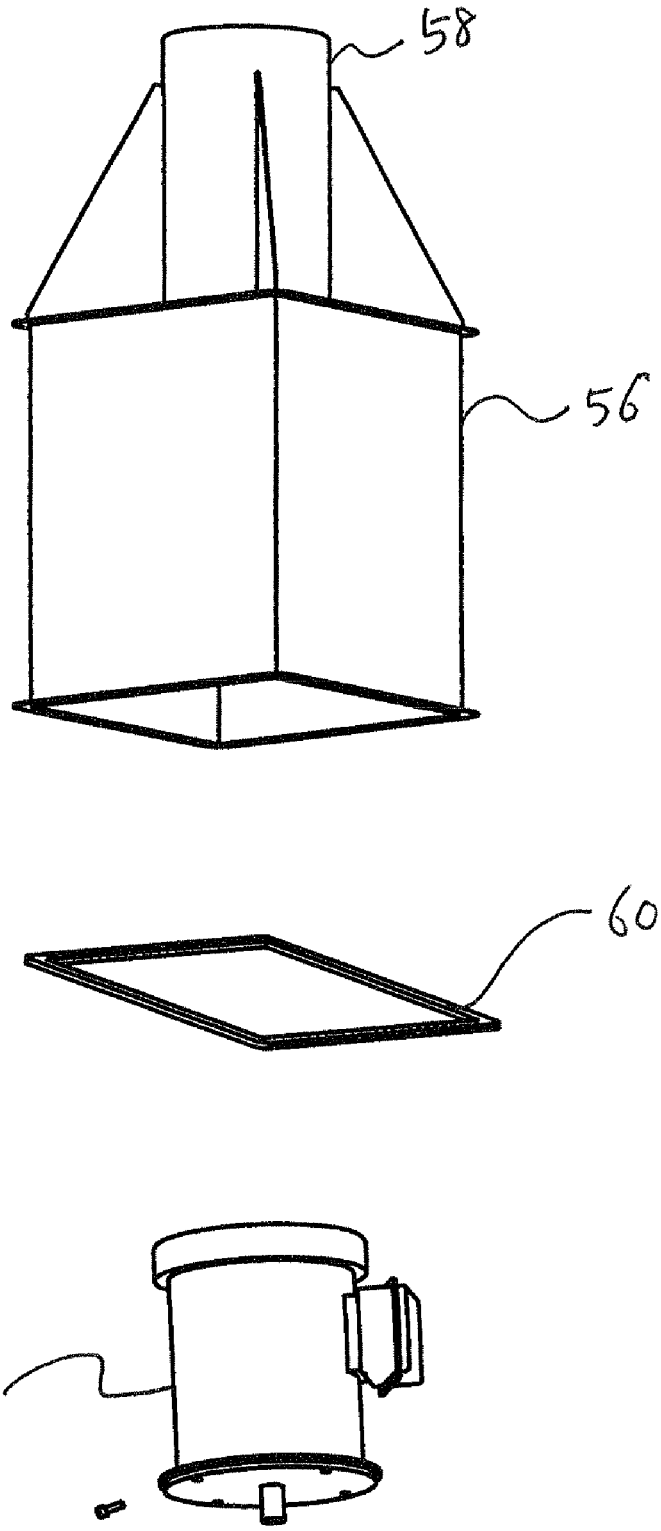
FIG. 8 is an enlarged perspective view of a cover, an O-ring and a motor.

FIGS. 2 and 8 show that the bubble generator 10 further comprises a motor mounting 54, on which the rotating device 18 is mounted, and a motor housing or a motor cover 56, which encloses the rotating device 18. The motor mounting 54 is installed on the upper open end 32 of the hollow cylinder 30. The motor cover 56 comprises a chimney fitting 58. An o-ring 60 is provided between the motor cover 56 and the motor mounting 54.

A chimney (not shown) may be assembled with the motor cover 56 with the chimney fitting 58, which is useful under circumstances where fresh air source is distant, such as when the bubble generator 10 is installed below a manhole. The motor cover 56 is assembled with the motor mounting 54 with bolts, and is made of stainless steel or plastic. The motor cover 56 protects the motor 48 from weather conditions.

Figure 9:
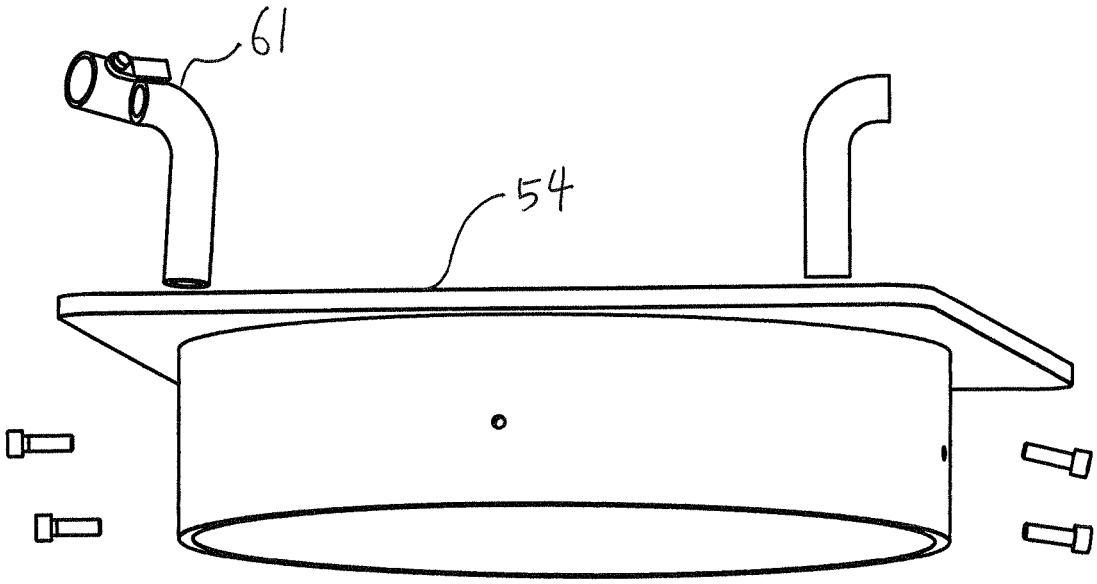
FIG. 9 is an enlarged perspective view of a motor mounting.

FIG. 9 shows that the air intake device 12 comprises one or more air intake control valves 61 that adjust the amount of air flowing into the air guide device 14. The air intake control valves 61 are installed on the motor mounting 54.

The air intake control valve 61 adjusts the amount of air that flows into the hollow cylinder 30 depending on factors such as viscosity of the waste water thereby preventing overload of the motor 48.

As the aeration disc 16 is rotated at high speed, negative pressure is created inside the air guide device 14, and air is sucked turbulently into the hollow cylinder 30 and toward the aeration disc 16.

Figure 10:
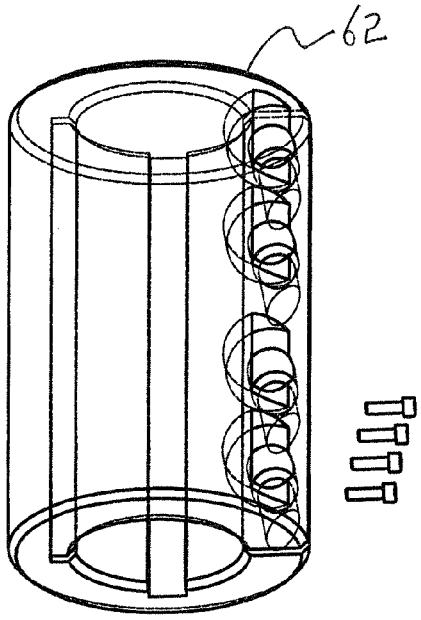
FIG. 10 is an enlarged perspective view of a coupling.
Figure 11:
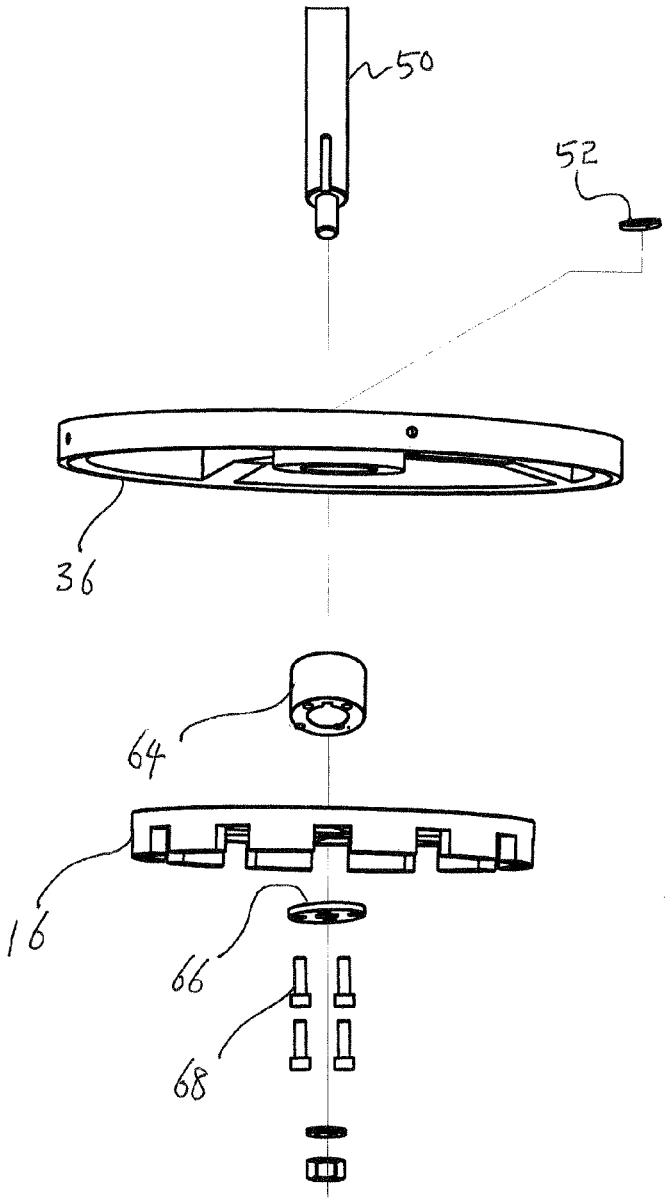
FIG. 11 is an enlarged perspective view of a shaft, the shaft guide and the aeration disc.

FIG. 10 shows a coupling 62 that is used to couple the shaft 50 to the motor 48. FIG. 11 shows a flange clamp 64 and a flange 66 that clamps the aeration disc 16 to the shaft 50 with bolts 68.

It is the objective of the bubble generator 10 to increase the supply of oxygen to organic sludge in the liquid in order to increase its rate of decomposition by aerobic bacteria.

Aerobic bacteria demand oxygen to decompose organic sludge or organic waste. In increasing the supply of oxygen to the aerobic bacteria and promoting gas exchange, air bubbles play a critical role. In addition to the air-liquid gas exchange that occurs at the surface level of the liquid, air bubbles provide additional surface area through which air-liquid gas exchange can occur.

Size of the air bubbles takes on great importance when considering an aeration apparatus that efficiently delivers oxygen to aerobic bacteria via air bubbles. Smaller air bubbles stay immersed in liquid for a longer duration. Ascent velocity of smaller air bubbles is lower than the ascent velocity of larger air bubbles. The longer the air bubble stays immersed in liquid, the longer the duration of the air-liquid gas exchange process. Tiny bubbles may stay immersed in liquid for several hours, allowing for more oxygen to be exchanged through the surface area of the bubble.

Radius of the air bubble determines the surface area-volume ratio of an air bubble. An air bubble with a smaller radius, having a higher surface area-volume ratio than an air bubble with larger radius, allows for more gas to be exchanged per volume of air. Greater amount of oxygen per volume of air is exchanged through the surface area of smaller air bubbles to be consumed by aerobic bacteria. Less time and energy is needed because more oxygen is consumed. Consequently, smaller air bubbles are more time and energy efficient in supplying oxygen to aerobic bacteria than larger air bubbles.

Most dissolved oxygen modeling of bodies of water that measure oxygen levels with a DO (dissolved oxygen) meter assume that oxygen is distributed uniformly throughout the body of liquid and are inadequate for analyzing the dynamics of oxygen dispersion. As is explained below, Brownian motion theory more accurately describes the movement of micro air bubbles in liquid.

Oxygen consumption by aerobic bacteria occurs nonuniformly in the septic water and is concentrated around the air bubble. Part of oxygen that is dissolved into water at the interface between air and water of the air bubble is consumed by bacteria that surround air bubbles and only the remaining part of dissolved oxygen is dispersed further from the air bubble. Part of the dissolved oxygen is also consumed by bacteria. The air bubbles and organic sludge only occupy small fractions of the entire water body volume. Since the aerobic bacteria are most active near source of oxygen and organic material, oxygen is consumed mostly around air bubbles that are positioned around organic sludge, and thus the oxygen consumption occurs nonuniformly in the water body. Also oxygen consumption by aerobic bacteria occurs before the dissolved oxygen is propagated uniformly into the water body. A DO meter simply measures the amount of oxygen dissolved uniformly in the water body and the result measured by a DO meter cannot reflect the nonuniform process that occurs very locally around air bubbles. A DO meter can only measure the amount of dissolved oxygen that remains after part of the oxygen is already consumed by aerobic bacteria concentrated around air bubbles. The smaller is the size of air bubbles, the longer the staying time of the bubbles and the larger the surface area of the bubbles are. For a given amount of air sucked into the bubble generator, the number of air bubbles generated is reversely proportional to the size of the air bubbles. Therefore size of the air bubbles is the most critical factor in the performance of bubble generator used for decomposing organic sludge in a water body. The present invention provides a unique structure for dramatically improving the performance by generating air bubbles having far less size than other types of bubble generators.

The benefits of using micro bubbles to efficiently deliver oxygen to aerobic bacteria are more easily appreciated under the Brownian motion model. Large air bubbles rise to the surface at a relatively high ascent velocity. However, small micro bubbles behave like a particle under the Brownian motion theory. The Brownian motion of micro bubbles in liquid is due to the instantaneous imbalance in the force exerted by even smaller liquid molecules. The movement of the micro bubbles is therefore random, and the micro bubbles disperse further in random directions in liquid, while larger air bubbles tend to rise to the surface.

While the invention has been shown and described with reference to different embodiments thereof, it will be appreciated by those skilled in the art that variations in form, detail, compositions and operation may be made without departing from the spirit and scope of the invention as defined by the accompanying claims. For example, the bubble generator of the present invention may be used for aeration applications in pharmaceutical industry and cosmetics industry, aquaculture, fish ponds, lade remediation, oil and water separation, drinking water treatment and hydroponic gardening. The bubble generator is also used for oxidizing various chemical materials including inorganic waste. Direct and fast oxidation occurs with the oxygen supplied by the micro air bubbles.

What is claimed is:

1. A bubble generator comprising:

a) an air intake device;

b) an air guide device, wherein the air guide device is adapted to be at least partially immersed in liquid, wherein the air guide device guides air flowed into the air guide device through the air intake device toward the liquid;

c) an aeration disc that is attached to the air guide device and produces negative pressure by being rotated in the liquid and moving the liquid whereby air guided by the air guide device produces air bubbles in the liquid; and d) a rotating device that rotates the aeration disc; wherein the air intake device provides ambient air into an air guide device, wherein the aeration disc comprises one or more blades that spin to create a vacuum of air moving downward through the air intake device and air guide device and into the liquid, and an arcuate wall that comprises one or more slots.

2. The bubble generator of claim 1, wherein the blades extend radially from the center of the aeration disc.

3. The bubble generator of claim 2, wherein the arcuate wall is connected with the blades.

4. The bubble generator of claim 3, wherein the arcuate wall forms a circumferential wall, wherein each of the slots of the arcuate wall comprises an open end, wherein the open end is directed toward the liquid.

5. The bubble generator of claim 4, wherein the circumferential wall comprises an annular ring that has a constant width and positioned cylindrical with respect to the rotation axis of the aeration disc.

6. The bubble generator of claim 1, wherein the air guide device comprises a hollow cylinder having an upper open end and a lower open end, wherein the aeration disc is installed at the lower open end.

7. The bubble generator of claim 6, wherein the air guide device further comprises a shaft guide which is installed inside the hollow cylinder and above and near to the aeration disc, wherein the shaft guide comprises an outer annular ring and a central air guide opening, wherein the outer annular ring comprises an outer peripheral wall that is fitted inside the hollow cylinder and an inner peripheral wall that defines the central air guide opening.

8. The bubble generator of claim 7, wherein the shaft guide further comprises an inner annular ring, wherein the rotating device comprises a motor and a shaft that connects the motor and the aeration disc, wherein the shaft is rotationally held by the inner annular ring.

9. The bubble generator of claim 8, wherein the shaft guide further comprises a bearing that is received in the inner annular ring and supports the shaft.

10. The bubble generator of claim 6, further comprising a motor mounting, on which the rotating device is mounted, and a motor cover, which encloses the rotating device, wherein the motor mounting is installed on the upper open end of the hollow cylinder, wherein the motor cover comprises a chimney fitting.

11. The bubble generator of claim 10, wherein the air intake device comprises one or more air intake control valves that adjust the amount of air flowing into the air guide device, wherein the air intake control valves are installed on the motor mounting.

* * * * *